United States Patent [19]

Thimon

[11] 4,429,510

[45] Feb. 7, 1984

[54] DEVICE FOR SHAPING A FILM OF HEAT-RETRACTABLE PLASTICS MATERIAL

[75] Inventor: Jacques Thimon, Tresserve, France

[73] Assignee: S.A. Thimon, Aix-les-Bains, France

[21] Appl. No.: 260,727

[22] Filed: May 5, 1981

[30] Foreign Application Priority Data

May 6, 1980 [FR] France ..... 80 10066

[51] Int. Cl.[3] ..... B65B 53/02

[52] U.S. Cl. ..... 53/167; 53/557; 264/230; 264/322; 425/384; 425/403

[58] Field of Search ..... 53/557, 442, 488, 567, 53/167; 264/230, DIG. 71, 322, 237; 425/384, 403; 493/190, 191

[56] References Cited

U.S. PATENT DOCUMENTS

| | | | |
|---|---|---|---|
| 2,885,105 | 5/1959 | Heyl | 264/230 X |
| 3,555,772 | 1/1971 | Kammer | 53/557 X |
| 3,581,460 | 6/1971 | Lambsdorf | 53/557 X |
| 3,600,875 | 8/1971 | Boub | 53/557 X |
| 3,706,176 | 12/1972 | Leatherman | 53/488 |
| 3,721,804 | 3/1973 | Feldman | 53/557 X |
| 3,853,218 | 12/1974 | Grasvoll | 53/442 X |
| 3,903,673 | 9/1975 | Grasvoll | 53/557 X |
| 3,958,392 | 5/1976 | Beninger | 53/442 X |
| 4,060,957 | 12/1977 | Birkenfeld | 53/557 X |

FOREIGN PATENT DOCUMENTS

| | | | |
|---|---|---|---|
| 2161389 | 6/1973 | Fed. Rep. of Germany | 53/442 |
| 2626660 | 12/1977 | Fed. Rep. of Germany | 53/442 |
| 2743568 | 3/1979 | Fed. Rep. of Germany | 53/442 |
| 2014535 | 8/1979 | Fed. Rep. of Germany | 53/557 |

*Primary Examiner*—John Sipos

*Attorney, Agent, or Firm*—McAulay, Fields, Fisher, Goldstein & Nissen

[57] ABSTRACT

A device for shaping a film of heat-retractable plastics material in the zone of the lateral spaces of a pallet-less multi-layer load having a layer of reduced width, said spaces for gripping purposes being defined by right-angled dihedrons, comprises mobile shaping elements intended to be applied against the film of plastics material which is still soft covering the faces of each dihedron defining a space for gripping.

Each shaping element is constituted by a bar and means are provided to displace each shaper bar in the direction of the edge of the dihedron, to engage said bar in the angle of the dihedron between the layer of reduced width and the normal layer of the load located beneath this reduced layer.

Each shaper bar is fast with one or more elements accelerating cooling of the plastics material. The or each cooling element is adapted to be applied against the vertical and horizontal faces of the dihedron defining the space for gripping, at the same time as the shaper bar is engaged in the angle of the dihedron.

5 Claims, 7 Drawing Figures

DEVICE FOR SHAPING A FILM OF HEAT-RETRACTABLE PLASTICS MATERIAL

BACKGROUND OF THE INVENTION

The present invention relates to a device for shaping a film of heat-retractable plastics material covering the lateral spaces for gripping a pallet-less multi-layer load having a layer of reduced thickness, these spaces for gripping being defined by right-angled dihedrons.

It is presently known to form pallet-less multi-layer loads from a plurality of articles stacked one on the other so as to form a substantially parallelepipedic assembly. These articles, which are, in particular, bags containing products (for example bags of cement), are grouped in superposed layers, each layer having a square or rectangular horizontal form. For forming a load without a pallet, a layer of reduced width is provided at the upper or lower part of the load, during stacking, said "reduced layer" being constituted by fewer articles and defined by a smaller square or rectangular geometrical surface than the peripheral surface of the normal layers. Consequently, the reduced layer defines, with the normal layer on or under which it is formed, two lateral empty spaces parallel to each other and in the form of right-angled dihedrons. The vertical side of each of these dihedrons is constituted by a lateral face of the reduced layer, whilst the horizontal side of this dihedron is formed by the portion of horizontal surface of the adjacent normal layer which remains exposed.

The lateral spaces thus defined by the reduced layer are used to enable the load to be gripped by a fork lift truck or by slings.

Once the load is thus formed with its reduced layer, it is packed beneath a film of plastics material, using several possible techniques (double wrapping, single or double covering . . . ). After the load has been packed, it is passed in a retraction oven. On leaving this oven, the plastics material, which is still hot, is softened and this softening is used to ensure shaping of the film so that it follows as closely as possible the faces of the dihedrons defining the spaces for gripping. This shaping is effected by mechanically pressing the soft plastics material by means of metal shaping elements.

Proper shaping must enable the plastics material to be definitively fixed, i.e. without its expanding when the shaping elements are withdrawn.

OBJECTS AND SUMMARY OF THE INVENTION

It is an object of the present invention to allow excellent shaping of the film of plastics material by very simple means, said film following very closely the faces of each dihedron defining a space for gripping, after it has cooled.

This object is realized according to the invention by a device for shaping a film of heat-retractable plastics material in the zone of the lateral spaces of a pallet-less multi layer load having a layer of reduced width, where the spaces for gripping purposes are defined by right-angled dihedrons, comprising mobile shaping elements intended to be applied against the film of plastics material which is still soft covering the faces of each dihedron defining a space for gripping, wherein each shaping element is constituted by a bar and means are provided to displace each shaper bar in the direction of the edge of the dihedron, to engage said bar in the angle of the dihedron between the layer of reduced width and the normal layer of the load located beneath this reduced layer.

The shaping device according to the invention offers the advantage that the film of still soft plastics material is pushed, by each shaper bar, into the angle between the upper layer and the subjacent normal layer, so that, even if the film expands a little thereafter, a perfectly right-angled dihedron is obtained after cooling, in each space for gripping, which facilitates subsequent handlings with a fork lift truck, for example.

According to a further feature of the invention, each shaper bar is fast with one or more elements which accelerates cooling of the plastics material. The or each cooling element is adapted to be applied against the vertical and horizontal faces of the dihedron defining the space for gripping, at the same time as the shaper bar is engaged in the angle of the dihedron. In this way, there is a substantial reduction in the overall time necessary for cooling the film placed around the load.

The cooling elements may be constituted by flat metal plates fast with the shaper bar and forming therewith an angle of which the edge is constituted by the bar. The shaper bar may also be fast with a chamber in the form of a box for blowing cooling air, this bar then extending along an edge of the box of which the two adjacent faces are perforated to allow the cooling air to pass in the direction of the vertical and horizontal faces of the dihedron defining the space for gripping.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
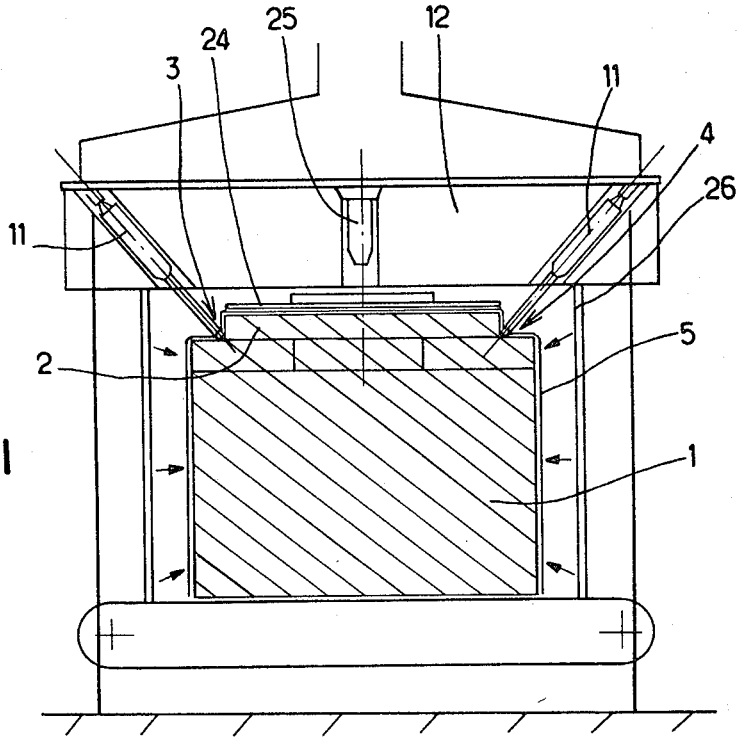
FIG. 1 is a schematic view in vertical and longitudinal section of a shaping device according to the invention.
Figure 2:
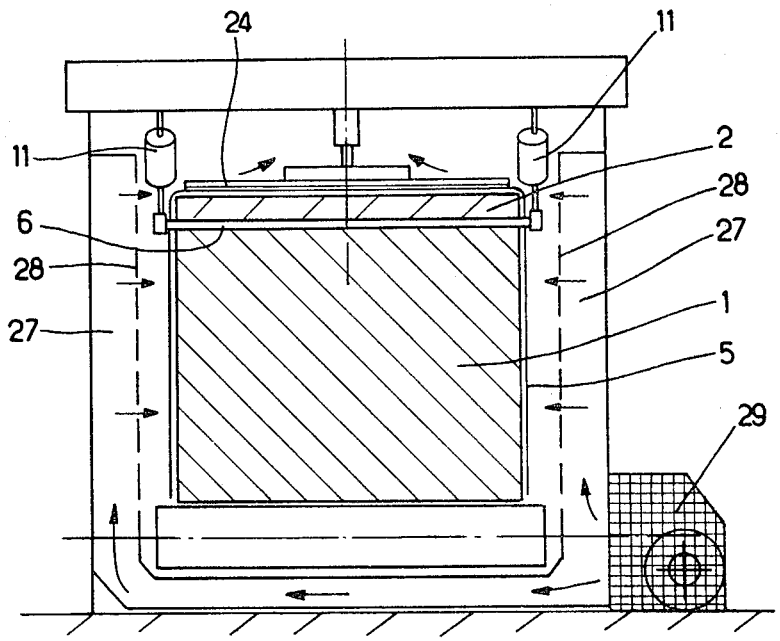
FIG. 2 is a schematic view in transverse section of the device of FIG. 1.

Referring now to the drawings, FIGS. 1 and 2 show a pallet-less multi-layer load 1 which is formed by a plurality of articles stacked on one another so as to form a substantially parallelepipedic assembly. These articles may for example be bags containing products (for example, cement bags). In the upper part of the load is formed a layer 2 of reduced width constituted by a fewer articles. Consequently, this reduced layer 2 defines, with the normal layer on which it is formed, two empty lateral spaces 3, 4 for gripping purposes, parallel to each other and in the form of right-angled dihedrons. These lateral spaces are then used for gripping the load by a fork lift truck, after this load has been turned through 180°.

Once this load has been formed, it is packed under a film of heat-retractable plastics material using several possible techniques, such as double wrapping, single or double covering, etc. This film 5 of plastics material, which constitutes for example a cover, is then softened by passing the load 1, provided with its packing film, in a retraction oven. On leaving this oven, the still hot plastics material is soft and can be shaped so that it follows as closely as possible the faces of the dihedrons defining the spaces 3 and 4 for gripping.

Figure 3:
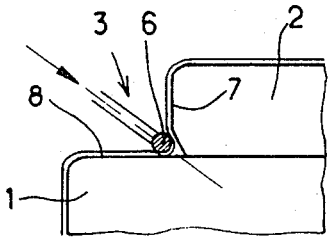
FIGS. 3 and 4 are transversal views illustrating different shaper bars.

The shaping device according to the invention comprises, for each of the spaces 3 and 4 for gripping, a shaper bar 6 which extends parallel to these spaces. As may be seen more readily in FIG. 3, the space 3 is defined by a dihedron which is formed by the vertical side face 7 of the reduced layer 2 and the horizontal top face 8 of the normal layer of the load 1 which is located immediately below the reduced layer 2. The bar 6 has a section and transverse dimensions which depend on the individual containers containing the products constituting the load. In the case of the products being packed in bags, the bar 6 is sufficiently small to be able to fit partially in the angle of the dihedron formed by the faces 7, 8 between the last normal layer of the load 1 and the reduced layer 2, as shown in FIG. 3.

Figure 4:
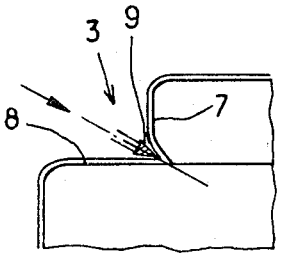

The shaper bar may have another shape adapted more particularly to its penetration in the angle of the dihedron 7, 8. As shown in FIG. 4, the shaper device may use a bar 9 of triangular cross section of which the apex is oriented in the direction of the edge of the dihedron 7, 8.

In the embodiment illustrated in FIGS. 1 to 4, the bar assembly 6, 9 is displaced in translation in the direction of the edge of the dihedron 7, 8. The direction of displacement of the bar depends on the structure of the load and on the nature of the products packed.

According to a variant embodiment, the bar 6 may be applied in the angle of the dihedron 7, 8 by a pivoting movement. Each shaper bar 6, 9 may also be divided into two sections disposed coaxially in position of support and displaced individually, in translation or in rotation.

FIGS. 1 and 2 show jacks 11 which control the movement of the bars 6. These jacks are pivoted on the upper part of the frame 12 of the shaping device and their axes are oriented so that the shaper bars 6 are displaced in the direction of the edges of the dihedrons 7, 8 defining the spaces 3, 4 for gripping purposes.

Figure 5:
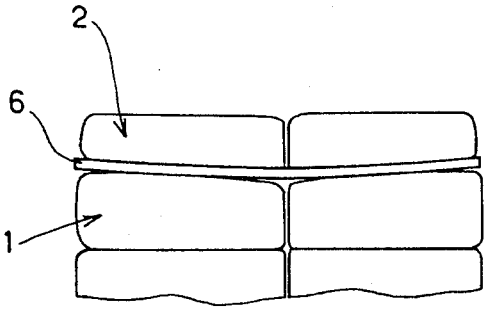
FIG. 5 is a front view of a curved shaper bar.
Figure 6:
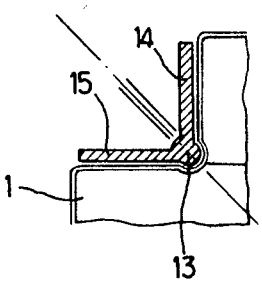
FIG. 6 is a view in transverse section of a shaper bar fast with two flat metal cooling plates forming an angle.

The shaper bars 6 may be rectilinear or slightly curved, as shown in FIG. 5, to follow the shape of a possible hollow at the joint between two bags constituting the last normal layer of the load 1.

To perfect shaping by an accelerated cooling of the surfaces of the film 5 of plastics material which are applied along the faces 7, 8 defining the spaces 3, 4 each shaper bar may be associated with flat metal forms allowing cooling by direct contact with two flat metal plates 14, 15, forming with the latter an angle with 13 located along the edge. The flat metal plates 14, 15 are in contact, during the shaping operation, with the zones of the film of hot plastics material 5 applied respectively against the faces 7, 8 of each of the dihedrons defining the spaces 3, 4 for gripping.

Figure 7:
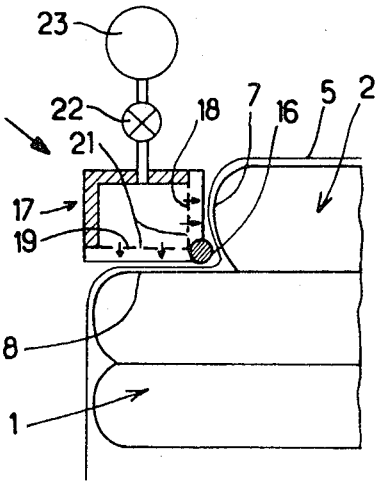
FIG. 7 is a schematic view in vertical section of a shaper bar fast with a chamber in the form of a box for blowing cooling air, in position of contact with the film of plastics material.

In the embodiment shown in FIG. 7, the shaper bar 16 is part of a chamber 17 in the form of a box for blowing cooling air. This box is parallelepipedic in form and the shaper bar 16 is disposed along the edge of the box facing the angle of the dihedron 7, 8. The two faces 18 and 19 of the box 17 which are adjacent the shaper bar 16 and which extend respectively opposite faces 7, 8 of the dihedron, are perforated with holes 21 for the passage of cooling air. The interior of the box 17 is connected, via a valve 22, to a source 23 of air under pressure (fan, centrifuge or blower).

The walls 18, 19 of the box 17 may also be porous plates allowing a diffusion of air, provided that the drops in pressure of the material allow a sufficient air velocity at the outlet.

The box 17 is designed so that, when it is pressed on the load, its walls 18, 19 are located at a certain distance from the film 5. During pressing, the valve 22 may be opened so as to supply the interior of the box 17 with air under pressure. This air escapes through the permeable walls 18, 19 and this cold air is thus projected against the film 5 of plastics material to ensure cooling thereof. The rate of flow of blowing air is determined as a function of the blowing surface so that pressing the boxes 17 leads to a homogeneous, high-speed blowing. The blowing of air thus enables the mechanical formation of the hot film to be combined with an accelerated cooling by air.

The shaping device according to the invention as just been described can be completed by an upper metal cooling plate 24 (FIG. 1) mounted to move vertically under the control of a jack 25 carried by the frame 12 of the device. The jack 25 is supplied so as to apply the upper plate 24 on the upper face of the reduced layer 2 when the shaper bars 6 are in low, clamped position, in which they are engaged in the angles of the dihedrons constituting the spaces 3, 4 for gripping. The plate 24 allows rapid cooling of the mixture of plastics material resulting from the formation of the top of the cover 5 of plastics material from a gusseted sheath.

The plate 24 may be air cooled, between two pressure applications, and provided with fins for increasing the heat exchange surface.

The shaping device according to the invention may also comprise blowing lips 26 (FIG. 1) which extend vertically opposite the vertical edges of the cover 5 covering the load. It may also comprise blowing boxes 27 (FIG. 2) which extend vertically opposite the vertical faces of the cover covering the load, these boxes 27 being inwardly defined by air-permeable faces 28. Fresh air may therefore be blown onto the edges and onto the vertical faces of the cover 5 covering the load, whilst shaping is being carried out in the upper part. The blowing lips 26 and the blowing boxes 27 may be connected to a source of pressurised air such as a fan 29.

The metal plate 24, the blowing lips 26 and the blowing boxes 27 enable the plastics material constituting the cover 5 to be definitively fixed or set, thus avoiding any tendency to deformation at the level of spaces 3, 4 by an untimely pull due to an unfinished retraction on the top or on the side faces of the cover.

Of course, the shaping device according to the invention is adjustable in height on its support, by any suitable means, so that it can be adapted to loads of different heights.

The assembly formed by the shaper bars 6, the upper cooling plate 24, the blowing lips 26 or the blowing boxes 27 may be incorporated in a structure of the tunnel or bell type comprising a frame supporting lateral walls with, inside, the blowing lips or boxes and, outside, members for suction of fresh air, the top part of this structure being arranged so as to support the actual shaping device and the cooling plate.

What is claimed is:

1. In a device for shaping a film of heat-retractable plastics material in the zone of the lateral spaces of a pallet-less, multi-layer load having a layer of smaller area than the area of the adjoining layer thereby forming spaces around said smaller layer defined by the faces of right-angled dihedrons including an angle therebetween with vertical and horizontal faces, comprising:

mobile shaping elements to be applied against said film of heated and soft plastic material covering the faces of each dihedron defining said spaces for gripping while said film is soft;

each shaping element consisting of a shaper bar having a periphery dimensioned to fit at least partially in said angle and forming part of a box-like chamber for blowing cool air, the shaper bar being disposed along the edge of said chamber facing the angle of the dihedron and said chamber having vertical and horizontal air-permeable faces which are adjacent the shaper bar extending respectively opposite the faces of the dihedron, the interior of said chamber being connected, via a valve, to a source of air under pressure; and means for displacing each shaper bar in the direction of the vertical and horizontal faces of said dihedron, to engage said bar with the film in the angle of the dihedron between said smaller layer and said adjoining layer of said load.

2. The device of claim 1, wherein said bar is circular in cross-section.

3. The device of claim 1, wherein said shaper bar is triangular in section and has an apex facing said angle.

4. The device of claim 1, having an upper metal cooling plate mounted to move vertically under the control of a jack, for applying said uper plate on the top face of said layer of reduced width when the shaper bars are in low clamping position in which they are engaged in the angles of the said dihedrons constituting said spaces for gripping.

5. The device of claim 4, further including:

means for adjusting the height of said shaping elements and a frame supporting said elements;

said means consisting of jacks pivoted on the upper part of said frame;

said jacks having their axes directed towards the faces of said dihedrons.

* * * * *